United States Patent [19]

Takenobu et al.

[11] Patent Number: 5,045,757

[45] Date of Patent: Sep. 3, 1991

[54] METAL VAPOR DISCHARGE LAMP

[75] Inventors: Iida Takenobu, Urawa; Shiina Jojiro, Gyouda, both of Japan

[73] Assignee: Iwasaki Electric Co., Ltd., Tokyo, Japan

[21] Appl. No.: 599,825

[22] Filed: Oct. 19, 1990

[30] Foreign Application Priority Data

Oct. 21, 1989 [JP] Japan ..... 1-271513

[51] Int. Cl.[5] ..... H05B 41/14; H01J 7/44; H01J 17/34

[52] U.S. Cl. ..... 315/59; 315/60; 315/73

[58] Field of Search ..... 515/51, 56, 58, 59, 515/60, 71, 73

[56] References Cited

U.S. PATENT DOCUMENTS 4,520,294 5/1985 Iida et al. ..... 315/50

4,897,576 1/1990 Iida et al. ..... 315/73

*Primary Examiner*—David Mis

*Attorney, Agent, or Firm*—Townsend and Snider

[57] ABSTRACT

A metal vapor discharge lamp comprising a FEC. a semiconductor switch and a thermal response switch and operated at a supply voltage of 100 to 130 V. The thickness if the FEC is 0.45 to 0.8 mm and the breakover voltage of the semiconductor switch is 60 to 100 V so that the discharge is safely caused in a light emitting tube and lighting at a voltage of −10% of the rated voltage is enabled. The open time of the thermal response switch is not less than 30 seconds so that starting is ensured even when the dimension of the light emitting tube is long or the pressure of xenon is high.

3 Claims, 1 Drawing Sheet

METAL VAPOR DISCHARGE LAMP

BACKGROUND OF THE INVENTION

1. Field of the Invention

The present invention relates to a metal vapor discharge lamp and, more particularly, to a metal vapor discharge lamp having a built-in starting circuit.

2. Description of the Prior Art

Metal vapor discharge lamps such as a high-voltage sodium lamp are widely used in a field of lighting for sports, commercial facilities, etc. by virtue of the high luminous efficiency and relatively good color rendering. Since it is difficult to start a high-voltage sodium lamp by a commercial supply voltage, for example, a starting circuit having the structure such as that shown in FIG. 1 is used.

A starting device shown in FIG. 1 composed of series circuit having switch 16 and glow starter 18. And the starting circuit is connected in parallel to the light emitting tube 12. Said light emitting tube 12 is connected to an AC power source 10 through a choke coil 14.

A metal vapor discharge lamp having outer bulb (illustrated in dotted line) provided with such a glow starter therein suffers from a problem that when the supply voltage is 100 to 130 V, the discharge lamp is instability to start.

This is because although the peak voltage of the pulse is sufficiently high for producing discharge in the light emittimg tube 12, the width of pulse (energy) is so small and the open circuit voltage (hereinunder referred to as "O. C. V.") as boosting voltage is so low as 100 to 130 V that it is difficult to shift to a stable arc discharge. So, it is very difficult to make metal vapor discharge lamp having starting circuit therein for low voltage.

SUMMARY OF THE INVENTION

Accordingly, it is an object of the present invention to eliminate the above-described problems in the prior art and to provide a metal vapor lamp which is capable of constantly starting even if the O. C. V. is 100 to 130 V.

To achieve this aim, a metal vapor discharge light according to the present invention has a built-in starting circuit composed of a series circuit having a ferrous electric capacitor (hereinunder referred to as "FEC") as non-linear characteristics, a semiconductor switch and a thermal response switch.

The thickness of the FEC is 0.45 to 0.8 mm, the breakover voltage of the semiconductor switch is 60 to 100 V and the open time (time from starting of discharge to opening of the switch) of the thermal response switch is not less than 30 seconds.

In a metal vapor discharge capacitor according to the present invention, since the thickness of the FEC is 0.45 to 0.8 mm, suitable coercive force voltage can be obtained. Since the breakover voltage of the semiconductor switch is 60 to 100 V, suitable pulse generation supply voltage can be obtained, and as described above, the discharge is safely produced in the light emitting tube, and lighting at a voltage of −10% of the rated line voltage is enabled.

In addition, since the open time of the thermal response switch is not less than 30 seconds, starting is ensured even if the dimension of the light emitting tube is long or the xenon pressure is high.

The electrodes of the light emitting tube are coil-type electrodes or sintered electrodes, and the weight thereof is preferably not more than 80 mg.

The above and other objects, features and advantage of the present invention will become clear from the following description of the preferred embodiment thereof, taken in conjunction with the accompanying drawings.

DESCRIPTION OF THE PREFERRED EMBODIMENT

An embodiment of the present invention will be explained with reference to the accompanying drawings.

Figure 1:
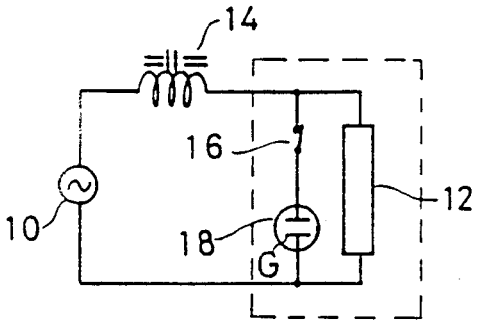
FIG. 1 is an explanatory view of a prior metal vapor discharge lamps having starting circuit therein.
Figure 2:
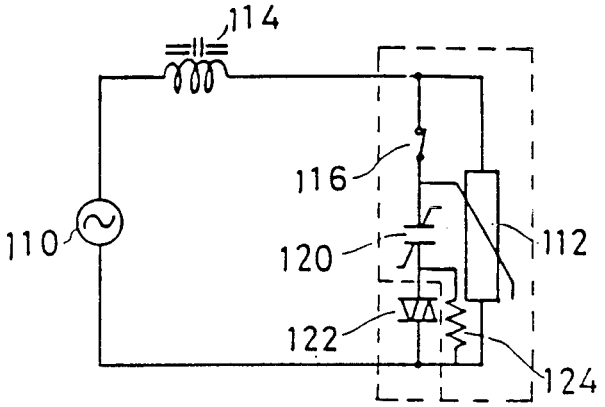
FIG. 2 is an explanatory view of a metal vapor discharge lamp using a starting circuit composed of a series circuit having a FEC, a semiconductor switch and a thermal response switch.

FIG. 2 shows a general metal vapor discharge lamp using a starting circuit composed of a series circuit having a FEC, a semiconductor switch and a thermal response switch. The elements corresponding to those shown in FIG. 1 are indicated by the same numerals prefixed by the numeral 1 and explanation thereof will be omitted.

The discharge lamp shown in FIG. 2 is composed of a series circuit including a switch 116, a FEC 120 and a bi-directional thyristor (semiconductor switch) 122, as a starting circuit, and a light emitting tube 112 which is connected to the series circuit in parallel.

By virtue of such a starting circuit using the FEC, it is possible to generate a pulse the phase of which is completely controlled. In addition, since the pulse energy is large enough to shift the starting of the lamp to a continuous arc discharge, an unnecessary pulse is not generated at the time of starting the lamp.

Even in a metal vapor discharge lamp having a built-in starting circuit such as that shown in FIG. 1, however, when the O. C. V. is 100 to 130 V, boosting voltage is lower than in a general case wherein the O. C. V. is 200 to 240 V.

Therefore, when the O. C. V. is 100 to 130 V, the light emitting tube does not sometimes generate a stable arc discharge.

To solve this problem, the present inventors investigated the functions of a FEC, a semiconductor switch and a thermal response switch.

The characteristic feature of the present invention lies in that the thickness of the FEC is set at a 0.45 to 0.8 mm, the breakover voltage of the semiconductor switch at 60 to 100 V and the open time of the thermal response switch at not less than 30 seconds.

The thickness of the FEC and the breakover voltage of the semiconductor switch were determined as follows.

The pulse generating supply voltage is generally required to be not more than −10% of the rated line voltage (100 to 130 V in the case of a low voltage).

The pulse generating phase voltage is the sum of the coercive force voltage (Ec) of the FEC and the breakover voltage ($V_{BO}$) of the semiconductor switch (hereinunder referred to as "SSS"), and the coercive force voltage Ec is determined by the thickness of the FEC.

Figure 3:
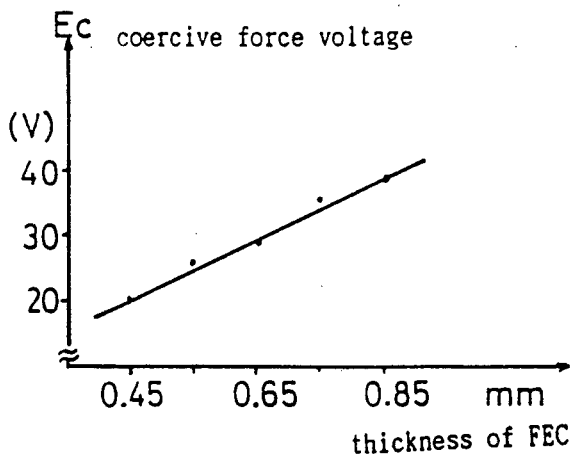
FIG. 3 is an explanatory view showing the relationship between the thickness and coercive force voltage of the FEC used in the lamp illustrated in FIG. 2.

FIG. 3 shows the relationship between the thickness and the coercive force voltage Ec of the FEC.

As is clear form FIG. 3, the coercive force voltage Ec and the thickness of the FEC are approximately proportional. When the thickness of the FEC is 0.45 mm, the coercive force voltage Ec is about 20 V, and when the thickness is 0.65 mm, 0.8 mm and 0.85 mm, respectively, the coercive force voltage Ec is about 30 V, 37 V and 40 V, respectively.

Table 1 shows the peak voltage of a pulse and the starting characteristic of the lamp obtained by setting the diameter of the metallized electrodes of the FEC constantly at 12.5 mm and varying the thickness of the FEC and the $V_{BO}$ of the SSS.

Pulse generating root mean square (r.m.s.) line voltage $=(Ec+V_{BO})/\times 1/\sqrt{2}$

TABLE 1

| | | | | | | | | | | |
|---|---|---|---|---|---|---|---|---|---|---|
| Thickness of FEC | 0.45 | 0.45 | 0.45 | 0.45 | 0.65 | 0.65 | 0.8 | 0.8 | 0.8 | 0.85 |
| $V_{BO}$ of SSS | 55 V | 60 V | 80 V | 100 V | 70 V | 80 V | 60 V | 80 V | 100 V | 100 V |
| Coercive force voltage (Ec) | 20 V | 20 V | 20 V | 20 V | 30 V | 30 V | 37 V | 37 V | 37 V | 40 V |
| Pulse generating phase voltage ($E_c + V_{BO}$) | 75 V | 80 V | 100 V | 120 V | 100 V | 110 V | 97 V | 117 V | 137 V | 140 V |
| Pulse generating r.m.s. line voltage (room temp.) | 53 V | 57 V | 71 V | 85 V | 68 V | 82 V | 96 V | 70 V | 77 V | 98 V |
| Pulse generating r.m.s. line voltage (−20° C.) | 65 V | 69 V | 83 V | 97 V | 80 V | 94 V | 108 V | 82 V | 89 V | 110 V |
| Pulse peak voltage | 950 V | 1000 V | 1170 V | 1450 V | 1000 V | 1050 V | 860 V | 950 V | 1200 V | 1150 |
| Starting characteristic of lamp *1 | Δ | ○ | ○ | ○ | ○ | ○ | × | Δ | ○ | ○ |

*1: Starting operation for all the lamps shifted to a continuous arc discharge within 30 sec: ○
Starting operation in some lamps did not shift to a continuous arc discharge within 30 sec: Δ
A continuous arc discharge was not obtained: ×

As is clear form Table 1, when the thickness of the FEC is 0.45 to 0.8 mm, it is possible to satisfy the condition of the pulse generating supply voltage by an appropriate combination of the breakover voltage of the SSS and the coercive force voltage of the FEC.

However, when the thickness of the FEC is 0.85 mm or more, it is necessary to raise the breackover voltage of the SSS up to about 100 V, so that the pulse generating supply voltage may not exceed −10% voltage of 130 V rated voltage at −20° C.

It is a generally necessary to light up a metal vapor discharge lamp at a pulse generating r.m.s. line voltage of −10% of the rated voltage. That is, it is necessary to light it up at a pulse generating r.m.s. line voltage of 108 V when the power source supplies 120 V and 117 V when the power source supplies 130 V.

In the case of using the FEC having a thickness of 0.85 mm and setting the $V_{BO}$ of the SSS at 100 V, the lamp starting voltage at normal temperature is satisfied for the time being. However, it is known that the pulse generating r.m.s. line voltage rises by about 12 V in an atmosphere of −20° C. Therefore, when the FEC of 0.85 mm thick is used and the $V_{BO}$ of the SSS is set at 100 V, the pulse generating r.m.s. line voltage rises to 110 V.

In other words, in order to ensure the starting voltage (pulse generating r.m.s. line voltage) for the lamp at −20° C., it is necessary to set the pulse generating r.m.s. line voltage in Table 1 at 96 V at the maximum. However, in an atmosphere of −20° C., the lamp starting voltage raises to 110 V and cannot satisfy the condition that the pulse generating r.m.s. line voltage is 108 V when the power source supplies 120 V.

On the other hand, if the thickness of the FEC is reduced, although higher pulse voltage is generated, the coercive voltage is lowered. When the thickness of the FEC is less than 0.45 mm, the substrate of the FEC may be shattered by mechanical vibration at lamp starting, thus, lower limit of the thickness of the FEC is 0.45 mm.

From the above results, it is understood that when the O. C. V. is 100 to 130 V, the thickness of the FEC is preferably 0.45 to 0.8 mm and the $V_{BO}$ of the SSS should be 60 to 100 V.

The open time of the thermal response switch will now be discussed.

The time (starting time) required for the discharge in the light emitting tube to shift to a complete continuous arc discharge is generally different depending upon the structure of a ballast, the structure of electrodes, the dimension of the light emitting tube, the pressure of xenon, and the like. The ballast is generally so designed as to fit to 50 Hz or 60 Hz. However, the loss in 10 to 50 KHz, which is the frequency of a pulse, varies, and when the loss is large, the energy of the pulse generated is lowered, thereby prolonging the starting time.

An electrode is generally composed of a coiled, tungsten wire wound around a tungsten rod and have various sizes. A sintered electrode is also used which is produced by press molding a mixture of tungsten powder and a powder of an electron emitting substance together with a tungsten rod and firing the molded product.

As to the life of a lamp, the larger an electrode is, the longer life the lamp has. This is because if the electrode is large, the amount of packed electron emitting substance increases and the operating temperature is lowered, thereby suppressing the sputtering of the electron emitting substance and the evaporation of the base metal (tungsten).

However, if an electrode larger than necessary is used, the temperature of the electrode is excessively lowered and the loss in arc increases, which makes the operation of the lamp unstable.

Conversely to the tendency between the structure of an electrode and the operation of the lamp, the starting characteristic (for shortening the starting time) of the lamp becomes better with the reduction in size of an electrode. The operation of the lamp is better when a coil-type electrode is used than when a sintered electrode is used.

The starting time was investigated on the basis of these factors, namely, the type of an electrode, the size of an electrode, the amount of adhered electron emitting substance.

The results are shown in Table 2

TABLE 2

| | Coil-type electrode | | | | | Sintered electrode | |
|---|---|---|---|---|---|---|---|
| Weight of coil portion or sintered portion | 40 | 60 | 80 | 100 | 120 | 50 | 90 |
| Amount of adhered electron emitting substance (mg) | 0.5 | 1.0 | 3.0 | 4.5 | 6.0 | — | — |
| Starting time (sec) | 2 | 15 | 30 | 60 | × | 15 | × |

As is clear from Table 2, the starting time is prolonged as the dimension of the light emitting tube becomes longer and the electrode becomes larger. When the pressure of xenon becomes higher, the starting time is also prolonged. It will be understood that during the starting time, constant pulses are necessary and the lamp cannot be lighted up without the generation of a pulse.

It is the thermal response switch that controls the pulse generating time. In order to light a light emitting tube in which the weight of the coil portion (or sintered portion) is not more than 80 mg, it is necessary that the thermal response switch is open for at least 30 seconds.

Metal vapor discharge lamps satisfying the above conditions were produced in the following way.

FEC
- outer diameter: 13.5 mm, thickness: 0.65 mm,
- diameter of metallized portion: 12.5 mm

SSS
- $V_{BO}$: 80 V

Light emitting tube
- wattage: 35 W
- pressure of Xe: 20 torr
- having sintered electrodes and outer auxiliary electrodes Resistor
- resistance Rs: 30 KΩ

The SSS was placed in the base and other parts were set in an outer bulb. The open time of the thermal response switch was set not less than 30 seconds and the contacting pressure at 20 g.

When the lamps were lighted at a supply voltage of 90 V by using a choke-type ballast (supply voltage: 100 v wattage: 35 W frequency: 50 Hz), all the lamps caused a stable arc discharge within 30 seconds and were lighted normally and followed by the opening of the thermal response switch.

As explained above, according to a metal vapor discharge lamp of the present invention, in which the thickness of the FEC is 0.45 to 0.8 mm, the breakover voltage of the semiconductor switch is 60 to 100 V and the open time of the thermal response switch is not less than 30 seconds, a stable arc discharge is ensured.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A metal vapor discharge lamp comprising a built-in starting circuit including a serial circuit having a ferrous electric capacitor, a semiconductor switch and a thermal response switch; wherein the thickness of said ferrous electric capacitor is 0.45 to 0.8 mm;

the breakover voltage of said semiconductor switch is 60 to 100 V;

the open time of said thermal response switch is not less than 30 seconds; and the supply voltage is 100 to 130 V.

2. A metal vapor discharge lamp according to claim 1, wherein the semiconductor switch is bi-directional thyristor.

3. A metal vapor discharge lamp according to claim 1, wherein an electrode of a light emitting tube is a coil-type electrode or a sintered electrode, and the weight of said electrode is not more than 80 mg.

* * * * *